United States Patent [19]

Trautlein et al.

[11] 4,390,099

[45] Jun. 28, 1983

[54] DISPLAY STAND FOR JEWELRY ARTICLES

[75] Inventors: Fred S. Trautlein, Fords, N.J.; James R. Stephens, New York, N.Y.

[73] Assignee: General Mills Products Corp., Minneapolis, Minn.

[21] Appl. No.: 203,167

[22] Filed: Nov. 3, 1980

[51] Int. Cl.[3] ..... A47F 7/02

[52] U.S. Cl. ..... 211/4; 211/13; 211/163; 211/205

[58] Field of Search ..... 211/13, 4, 7, 163, 166, 211/205, 196, 54.1, 57.1, 59.1; 70/459, 456, 58, 61, 62

[56] References Cited

U.S. PATENT DOCUMENTS

| | | | |
|---|---|---|---|
| 743,276 | 11/1903 | Hammock | 211/13 |
| 765,823 | 7/1904 | Erb | 70/456 R |
| 1,162,955 | 12/1915 | Vaughan | 70/456 R |
| 1,727,515 | 9/1929 | Mendle | 211/163 |
| 1,762,185 | 6/1930 | Mendle | 211/163 |
| 2,165,915 | 7/1939 | Berger et al. | 211/13 |
| 2,218,329 | 10/1940 | Dunberg | 211/13 |
| 2,287,418 | 6/1942 | Dudley | 211/59.1 |
| 3,862,735 | 1/1975 | Cohen | 211/166 X |

*Primary Examiner*—Francis K. Zugel
*Assistant Examiner*—Robert W. Gibson, Jr.
*Attorney, Agent, or Firm*—Gene O. Enockson; L. MeRoy Lillehaugen

[57] ABSTRACT

A pilfer resistant device for holding articles such as jewelry chains, necklaces and the like. The device includes a circular display member upon which the chains are positioned, by slipping them through one or more separations or spaces formed in the display member, so that the chain can be suspended over the member. Small sleeves, having the same arc as the display member, are slidably mounted on the display member for closing the gaps formed in the display member. By rotating the sleeve a small amount with respect to the display member, the sleeve can be effectively locked onto the display member.

13 Claims, 9 Drawing Figures

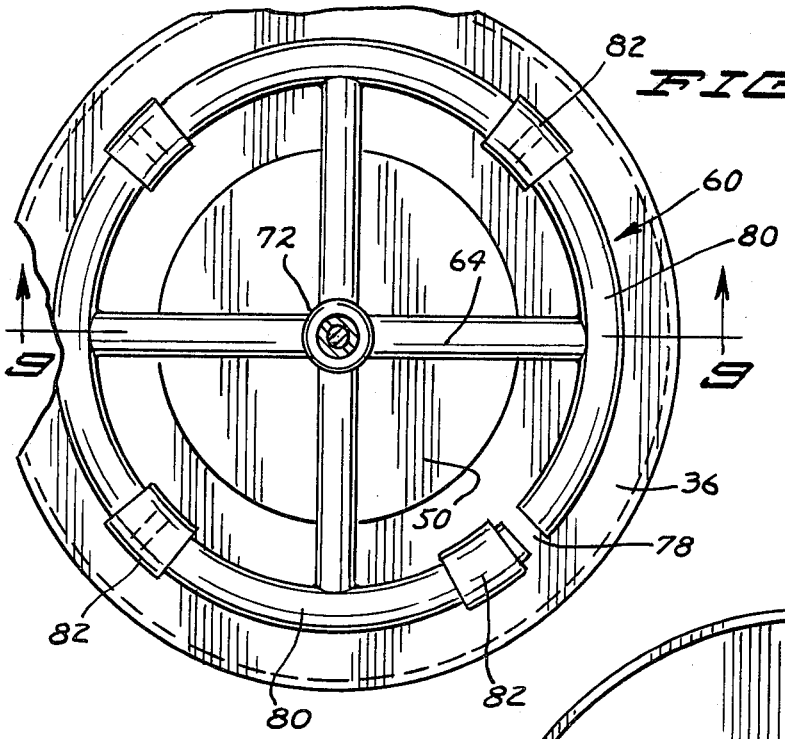
FIG. 3
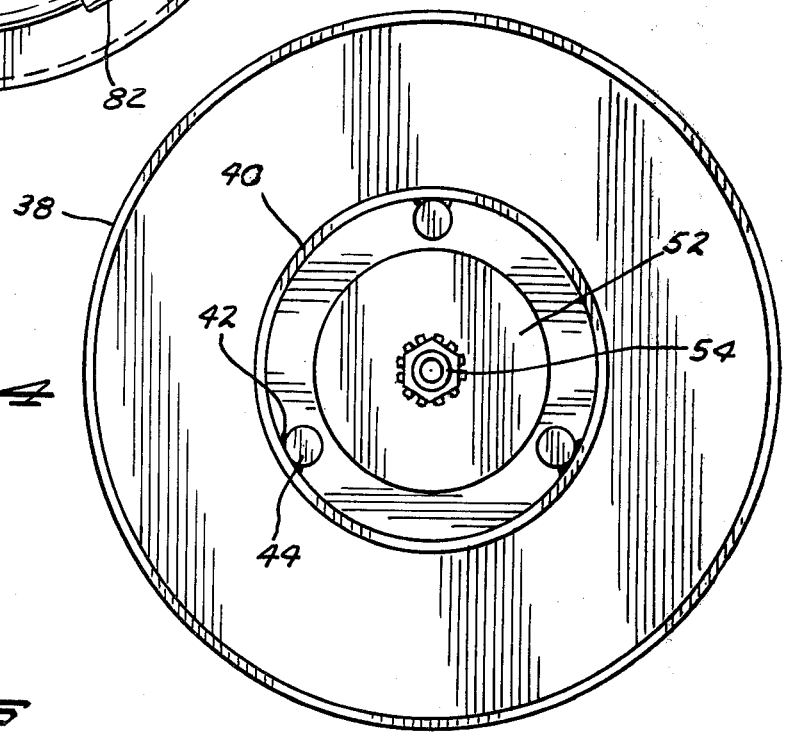
FIG. 4
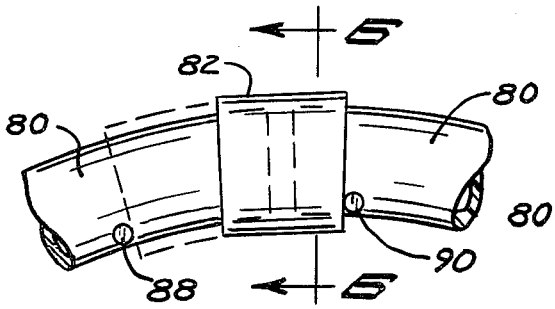
FIG. 5
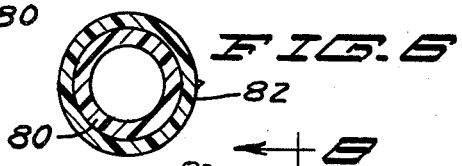
FIG. 6
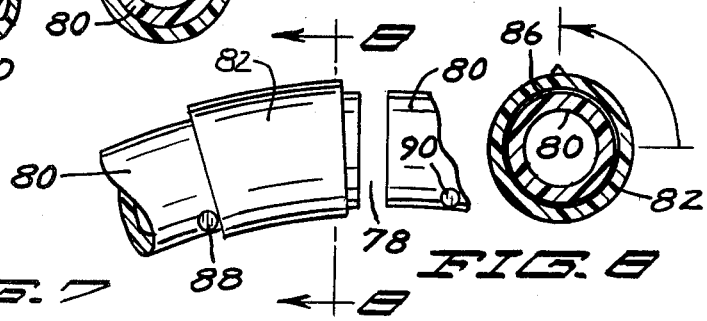
FIG. 7
FIG. 8

DISPLAY STAND FOR JEWELRY ARTICLES

BACKGROUND OF THE INVENTION

The present invention relates to display fixtures or devices for holding merchandise, and more particularly to a pilfer resistant display stand which supports jewelry chains or necklaces in such a manner that they cannot readily be removed from the stand.

Numerous types of display fixtures are known in the art for holding a variety of jewelry articles, including earrings, bracelets, necklaces, rings and the like. Customarily, stores which market jewelry articles prefer to exhibit the articles so that they are prominently displayed to prospective customers. Display fixtures of this type should be aesthetically attractive, so as to not detract from the merchandise being displayed, occupy a minimum amount of space, since they ofttimes are positioned on a counter top for easy access and view, and hold a large amount of merchandise.

Pilferage or theft of merchandise mounted on a display is a critical problem, and large sums of money are lost each year due to theft of merchandise. Since merchandise of the jewelry type must be conveniently located for a prospective buyer, it is not uncommon that large amounts of merchandise are stolen if some system is not provided to prevent such acts. Thus, it has been discovered that some system or procedure is desirable to prevent or minimize unauthorized removal of the merchandise from the display device.

SUMMARY OF THE INVENTION

Accordingly, one object of the present invention is to provide an improved display fixture for holding and exhibiting jewelry articles.

Another object is to provide a display stand for jewelry chains and necklaces, which includes features for preventing or minimizing theft or pilferage therefrom.

A further object is to provide an anti-theft display stand which permits jewelry articles to be readily mounted or removed therefrom by authorized personnel, while nevertheless, minimizing removal of such articles by unauthorized personnel.

Another object is to provide a jewelry display device which is simple in construction, aesthetically appealing, and relatively inexpensive to manufacture.

Other objects and advantages of this invention will become apparent from a consideration of the following specification and accompanying drawings. Before proceeding with a detailed description of the invention, however, a brief resume of it will be presented.

In general, the invention includes a center post which is attached at a first end to a base member so that it is vertically oriented. A circular display member is rotatably mounted on the second end of the post. The display member is provided with a plurality of separations or openings, which permit jewelry articles to be mounted on the circular member. A plurality of closure members or sleeves are slidably mounted on the circular member for closing the gaps formed by the openings; such sleeves adapted to be effectively locked so as to minimize unauthorized removal of the jewelry articles from the display stand.

BRIEF DESCRIPTION OF THE DRAWINGS

The invention will best be understood by reference to the following drawings, wherein:

FIG. 3 is a top plan view taken along line 3—3 of FIG. 2;

FIG. 4 is a bottom plan view of the display stand;

FIG. 5 is an enlarged partial view which illustrates a portion of a circular display member forming a part of the display stand, in a first or closed condition;

FIG. 6 is a cross-sectional view taken along line 6—6 of FIG. 5;

FIG. 7 is an enlarged partial view which illustrates a portion of the circular display member in a second or open condition;

FIG. 8 is a cross-sectional view taken along line 8—8 of FIG. 7.

DESCRIPTION OF THE PREFERRED EMBODIMENT

Figure 1:
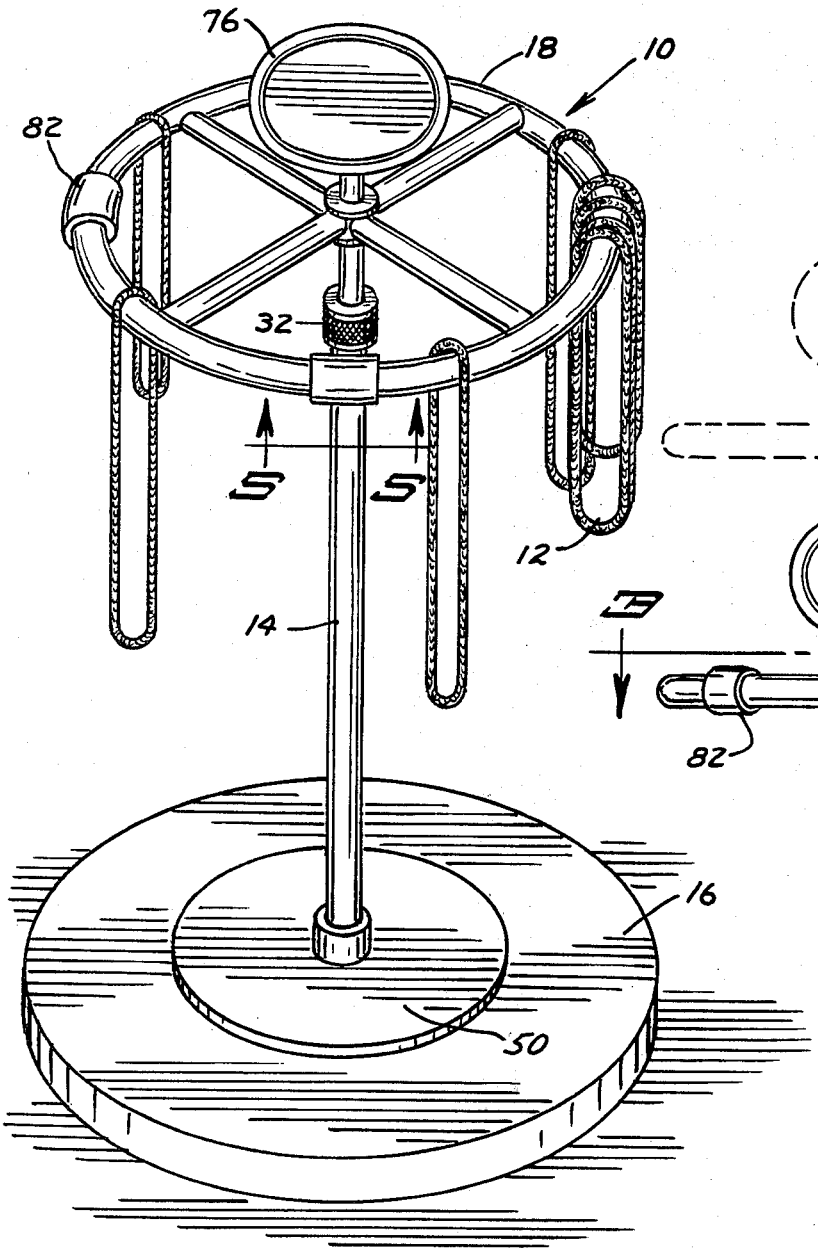
FIG. 1 is a perspective view of a display stand constructed in accordance with the invention.
Figure 2:
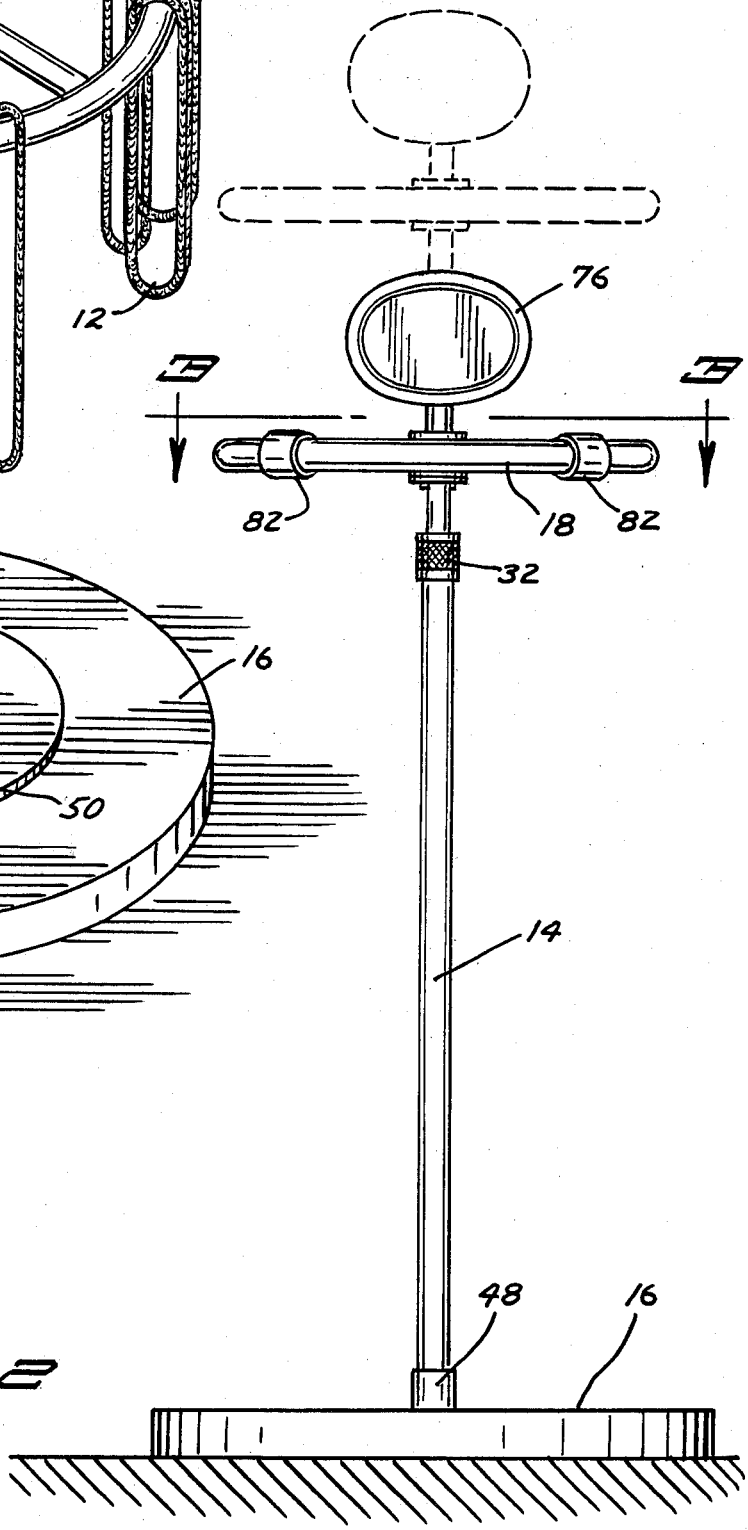
FIG. 2 is a front elevational view of the display stand.

FIG. 1 illustrates a display stand designated generally by reference numeral 10, for holding and displaying articles of jewelry such as chains or necklaces 12. The display stand 10 can be mounted on any horizontal surface, such as a display counter in a department or jewelry store. The display stand includes a vertically oriented center post 14, a base member 16 attached to a first or lower end of the post 14, and a display member or loop 18 mounted on a second or upper end of the post 14 so that it is horizontally aligned and elevated with respect to the base member 16.

Figure 9:
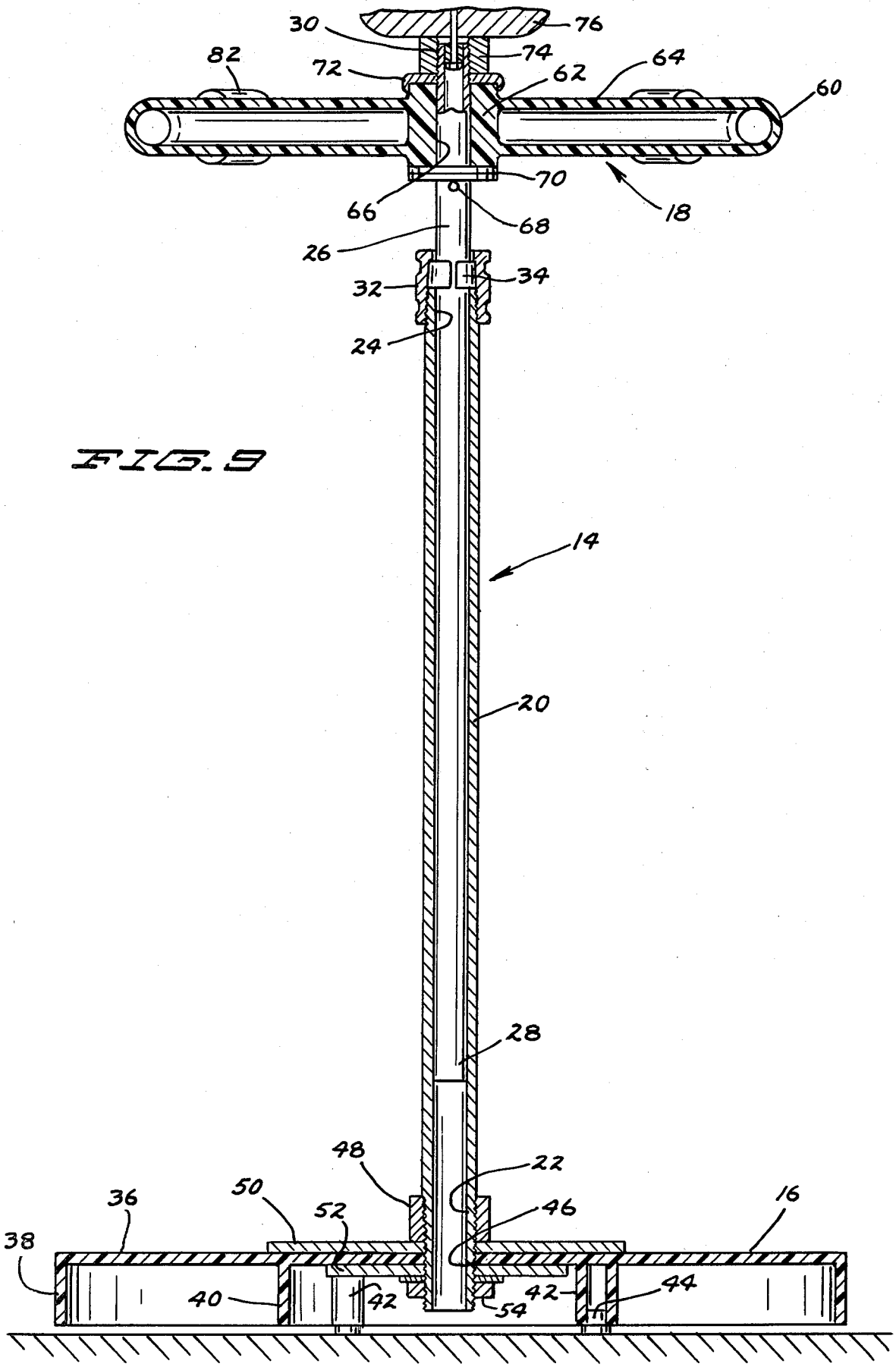
FIG. 9 is a sectional view taken along line 9—9 of FIG. 3.

FIG. 9 illustrates the manner in which the post 14, the base member 16 and the circular member 18 are connected together. The post 14 includes a first or outer tubular member 20 which is threaded at its lower and upper ends 22 and 24 respectively; a second or inner tubular member 26 is slidably mounted within the tubular member 20 so that its first or lower end 28 is proximate the base 16. A second or upper end 30 projects above the member 20 and it is threaded. The tubular members 20 and 26 are adjustably connected together by means of a nut 32 and a split-ring 34 assembly; assemblies of this type are well known in the art. By loosening the nut 32, the member 26 can be vertically adjusted with respect to the member 20.

The base member 16 is preferably formed of transparent, plastic material, such as acrylic resin, which allows light to pass through it, although it should be recognized that a variety of other materials might be used, as well. The base member 16 has a cylindrical shape and it includes a flat plate 36 surrounded by a downwardly projecting circular rim 38. The diameter of the base member 16 should preferably be greater than the diameter of the member 18. A circular rib 40 projects downwardly from the underside of the plate 36 in such a way that it is concentric with the rim 38. The rib 40 forms a small cavity on the underside of the base member 16, and it supports the load exerted by the post 14 on the plate 36. A plurality of legs 42 are connected to the rib 40, and they are provided with rubber inserts or tips 44, which are positioned on the counter top or support surface, and prevent scratching or defacing of the counter top.

The post 14 is attached to the base member 16 by inserting the threaded end 22 into a bore 46 in the base. Prior to such insertion, a circular nut 48 is threaded onto the end 22, and a circular plate 50 is mounted on the post so that it is interposed between the nut 48 and the top surface of the base member 16. A second circular plate or washer 52 is positioned on the post end 22 within the cavity formed by the rib 40, after which a washer and nut assembly 54 are threaded onto the end 22. By tightening the nut 54, the post 14 is fixedly connected to the base member 16. For reinforcing and aesthetic purposes, it is preferred that the plate 50 have a diameter slightly larger than the diameter of the rib 40; this effectively conceals the plate 52, as well as the nut and washer assembly 54, from view. More importantly, however, the plate 50 helps distribute the weight of the display member 18 and the chains 12 mounted on it, over a greater area of the plate 36. The rib 40 reinforces the plate 50 in the area which is subjected to the greatest amount of weight.

As depicted in the figures, the display member 18 has a generally circular configuration and it resembles the appearance of a steering wheel. Member 18 includes a tubular ring member 60 having a circular cross sectional shape. Such ring being connected to a hub 62 by a plurality of spokes 64. While the display member might be formed of a number of materials, it is preferably formed of a clear plastic material.

The hub 62 is provided with a bore 66 which permits the display member to be rotatably mounted on the upper end of the post 14, and more specifically, the end 30 of the tubular member 26. A pin 68 is driven into a small bore in the tubular member 26 and it prevents the hub 62 from sliding down the member 26. A pair of washers 70 are interposed between the pin 68 and the bottom of the hub 62. A metal cap 72 fits over the upper end of the hub and a circular nut 74 threadedly engages the second end of the tubular member 26 so that the circular member 18 can be freely rotated relative to the post 14. If desired, a finial 76 can be attached to the projecting end of the tubular member 26, by appropriate means, and this can serve as a means for identifying the manufacturer of the jewelry, and the like.

The ring member 60 is provided with a plurality of gaps or spaces 78 which effectively separate the ring into segments or or sections 80 of substantially equal length. While the width of the gap might vary, it should be wide enough to permit jewelry articles to be passed through such gap. The sleeves are slidable along the periphery of the ring. As can be seen in FIG. 3, for example, each segment 80 is attached to the hub 62 by a spoke 64. Sleeves 82 are provided for encircling or surrounding the gaps 78, and their length must be greater than the width of the gaps. The sleeves 82 provide the pilfer resistant feature by providing means for closing the gaps between the segments, so as to prevent merchandise such as necklaces or chains 12, from being readily removed from the ring 60. The sleeves are preferably formed of a clear plastic material.

As viewed more clearly in FIGS. 5–8, the sleeves 82 are molded or formed so that they have substantially the same arc as that of the segments 80; moreover, the inside diameter of the sleeves is slightly larger than the outside diameter of the segments, so that a small space 86 exists between the two, note FIG. 8; this permits the sleeve to slide along the perimeter of the member 60. By rotating the sleeve 82 a small amount, e.g., up to about 45°, the sleeve is effectively locked relative to the segments 80. The resistance created by the two opposing arcs provides for a firm locking mechanism. In this regard, note FIG. 6 which illustrates the sleeve 82 in a locked condition. Each segment 80 is also provided with a pair of protuberances or knobs 88 and 90, proximate the gaps 78. The knob 88 is spaced sufficiently far away from the gap 78 so that when the sleeve is moved to the left is viewed in FIGS. 5 and 7, the gap 78 is exposed; in other words, the distance between the knob 88 and the gap 78 is greater than the length of the sleeve 82. The knob 90, on the other hand, is positioned closer to the gap 78 so that the sleeve surrounds or encircles the gap when it abuts against the knob 90, as depicted in FIG. 5; thus the distance between the knob 90 and the gap is less than the sleeve length. The knobs 88 and 90 prevent the sleeves 82 from being slid or moved away from the general area of one of the gaps 78.

In assembled condition, the display member 18 is mounted on the post 14 so that articles mounted on the ring 60, such as jewelry chains and necklaces 12, hang down. Since the post 14 is vertically adjustable, i.e., by loosening the nut 32 and extending or retracting the tubular member 26 relative to the tubular member 20, the display stand can accommodate chains of various lengths. Chains are mounted on the ring 60 by sliding a sleeve 82 so that it abuts against the knob 88, thus exposing the gap 78. (See FIG. 7). Chains can now be readily slipped onto the ring 60. When the display is filled, the sleeve 82 is slid to its closed position (see FIG. 5), and it is rotated or twisted so as to lock it in place. The chains are then preferably separated and positioned along the segments 80 as well as the sleeve 82, thereby covering the opening sufficiently to prevent customers from determining where and how the jewelry articles can be removed from the display.

When it is desired to remove a chain from the display stand, for example, when a purchase has been made by a customer, the store personnel can either remove the chain from the display by opening a clasp mechanism attached to the chain (if it has such a mechanism) or by twisting the sleeve 82 and sliding it so as to open or uncover the gap 78.

At this point, it might be pointed out that while the figures disclose the display member 18 as having a circular shape or configuration, it is envisioned that other shapes might also be used. If preferred, for example, member 18 might have an oval shape; in such an instance, however, if more than one gap and sleeve are provided, the sleeves might not all have the same arc, since the arc of an oval shaped display member would vary along its perimeter. In order to assure the locking feature, it is important that the respective arcs of the display member and a sleeve which surrounds a specific gap, oppose each other as the sleeve is related with respect to a display member.

While it is envisioned that the display device might be made of a variety of materials, as indicated hereinbefore, it is preferable that the base member 16 and the circular display member 18 be formed of hard, clear plastic material. The post 14 and the plate 50, on the other hand, are preferably formed of chrome plated metal, or the like. These aspects are, of course, optional, and if desired, a variety of materials and colors might be used.

It should be pointed out that while the invention has been described in conjunction with jewelry articles such as chains or necklaces, it must be realized that the invention can be effectively used for storing or holding a variety of articles. The invention effectively minimizes unauthorized removal of articles from the display device, and jewelry articles are highly susceptible to theft.

In the above description and attached drawings, a disclosure of the principle of the invention is presented, together with a specific embodiment by which the invention might be carried out.

Now, therefore, we claim:

1. A display member comprising a loop member, a hub, spoke means for attaching said loop member to said hub, said loop member having a substantially circular cross-sectional configuration, said loop member being formed with a plurality of gaps which separate the loop into a plurality of segments, a plurality of sleeve means movably mounted on said loop segments, said sleeve means having substantially the same arc as the loop member, each sleeve means being movable along the periphery of said loop member whereby it surrounds a gap, each said sleeve means being effectively locked with respect to said loop member by rotating it relative to said loop member, and means for mounting said display member with respect to a support structure.

2. A display stand for holding a plurality of jewelry articles comprising a vertically oriented post member, a base member, means for attaching said base member to a first end of the post member, a display member, means for attaching said display member to the second end of the post member so that it is horizontally aligned and elevated with respect to the base member, said display member including a ring member which is formed with at least one gap, a sleeve movably mounted on the ring member, said sleeve having substantially the same arc as the ring member and being slidable along the periphery of said ring member so that it surrounds said gap, said sleeve being effectively locked with respect to said ring member by rotating it relative to said ring.

3. The combination of claim 2 wherein means are provided for limiting movement of the sleeve along the perimeter of the ring member.

4. The combination of claim 2 wherein the base member has a diameter which is greater than the diameter of the ring member, and a reinforcing circular rib is provided on the undersurface of the base member for supporting the load exerted by the post.

5. The combination of claim 4 wherein the means for attaching the post member to the base member includes a plate mounted on the top surface of said base member which distributes the load over a portion of the base member, said plate having a larger diameter than the diameter of the reinforcing rib.

6. A display stand for holding a plurality of jewelry articles comprising a vertically oriented post member, a base member, means for attaching said base member to a first end of the post member, a display member, means for attaching said display member to the second end of the post member so that it is horizontally aligned and elevated with respect to the base member, said display member including a ring member which is formed with a plurality of gaps for separating the ring member into a plurality of segments, the means for attaching the ring member to the post member includes a plurality of spokes connected to the ring segments, a sleeve movably mounted on the ring member, said sleeve having substantially the same arc as the ring member and being movable along the periphery of said ring member so that it surrounds one of said gaps, said sleeve being effectively locked with respect to said ring member by rotating it relative to said ring.

7. The combination of claim 6 wherein the gaps are substantially equidistantly spaced around the ring member and the ring segments are substantially the same length.

8. The combination of claim 6 wherein the length of each sleeve is greater than the width of its associated gap.

9. The combination of claim 6 wherein means are provided for rotatably connecting said ring member relative to the post member.

10. The combination of claim 6 wherein means are provided for vertically adjusting said ring member relative to the base member.

11. The combination of claim 6 wherein the ring member is tubular and it has a substantially circular cross-sectional configuration.

12. A display stand for holding a plurality of jewelry articles comprising a vertically oriented post member, a base member, means for attaching said base member to a first end of the post member, a display member, means for attaching said display member to the second end of the post member so that it is horizontally aligned and elevated with respect to the base member, said display member including a ring member which is formed with at least one gap, a sleeve movably mounted on the ring member, means for limiting movement of the sleeve along the perimeter of the ring member, said means including a pair of knobs mounted on the ring member proximate the gap and on opposite sides of said gap, said sleeve having substantially the same arc as the ring member and being movable along the periphery of said ring member so that it surrounds said gap, said sleeve being effectively locked with respect to said ring member by rotating it relative to said ring.

13. The combination of claim 12 wherein a first knob is positioned closer to the gap than a second knob, said second knob being spaced a distance which is greater than the length of the sleeve, said first knob being spaced a distance which is less than the length of the sleeve.

* * * * *